US006007065A

United States Patent [19]

Ress

[11] Patent Number: 6,007,065

[45] Date of Patent: Dec. 28, 1999

[54] MULTI-SIDED TAPERED DICE

[76] Inventor: Gary A. Ress, 14114 Tree Crest Ct., Louisville, Ky. 40245

[21] Appl. No.: 09/095,685

[22] Filed: Jun. 10, 1998

[51] Int. Cl.[6] ..... A63F 9/04

[52] U.S. Cl. ..... 273/146

[58] Field of Search ..... 273/146, 290, 273/147; 446/117

[56] References Cited

U.S. PATENT DOCUMENTS 3,063,602 11/1962 Anderson .
3,443,715 5/1969 Edwards .
5,150,900 9/1992 Onzo .
5,375,845 12/1994 Cooter .

*Primary Examiner*—William M. Pierce
*Attorney, Agent, or Firm*—Wheat, Smith & Beres, PLC; Vance A. Smith; David W. Nagle, Jr.

[57] ABSTRACT

A game die has a plurality of faces arrayed about a central vertical axis, each face displaying numerical or other indicia. These faces are tapered at an angle relative to said vertical axis, allowing the die to be thrown or spun and causing the die to roll about a central point once it ceases sliding across a surface. The die also defines an internal cavity for receiving a portion of a second die, thereby allowing stacking of the dice.

7 Claims, 5 Drawing Sheets

MULTI-SIDED TAPERED DICE

BACKGROUND OF THE INVENTION

The present invention relates to game dice, and, more particularly, to a tapered game die that travels in a circle once sliding of the die has ceased, thereby preventing the die from rolling off of the surface onto which it is thrown.

There have been a wide array of dice that have been developed and used as random number generators in conjunction with games and other amusements. The most common of such game dice are the small cubes marked on each face with from one to six spots. However, many other geometric shapes and configurations have been used as game dice. For example, U.S. Pat. No. 4,239,226, issued to Palmer, describes a ten-sided die, specifically comprised of two, identical five-sided pyramids. Such a geometrical arrangement reduces the likelihood of side-to-side tumbling of the dice, thereby ensuring true random generation of numbers. U.S. Pat. No. 4,989,874, issued to Freitas, describes a set of six dice, each die being a dodecahedron (or ten-sided solid) with numbers printed on either eight or nine of its surfaces. U.S. Pat. No. 1,419,056, issued to Kaufmann, describes a die that is preferably a fourteen-sided polyhedron. The die has essentially a first and second portion, each portion having six quadrilateral sides that terminate to form a hexagonal end. The two portions are joined at their respective bases.

Each of these dice, however, often roll and tumble in a line, in a manner very similar to conventional six-sided dice. Such rolling action creates a likelihood that the dice may roll off of the table or surface onto which they are thrown.

It is thus a primary object of the present invention to provide a game die that rolls in a circle once it ceases to slide across a table or similar surface.

It is a further object of the present invention to provide game dice that may be stacked atop one another, thereby allowing for simple storage of the dice.

It is still a further object of the present invention to provide game dice that can be tossed conventionally or can be spun like a top for increasing the enjoyment of throwing the dice.

SUMMARY OF THE INVENTION

The present invention is a game die. A preferred game die has a plurality of faces arrayed about a central vertical axis, each face displaying numerical or other indicia. These faces are tapered at an angle relative to said vertical axis, allowing the die to be spun and causing the die to roll about a central point once it ceases sliding across a surface. This prevents the die from rolling off of the surface onto which it is thrown. Furthermore, the die defines an internal cavity for receiving a portion of a second die, thereby allowing stacking of the dice.

DESCRIPTION OF THE PREFERRED EMBODIMENTS

The present invention is a game die that is formed by a plurality of quadrilateral walls arrayed about a central vertical axis. This die can be used in conjunction with a variety of games, including well-known dice games like craps and YAHTZEE®. (YAHTZEE® is a registered trademark of the Milton Bradley Company.)

Figure 4:
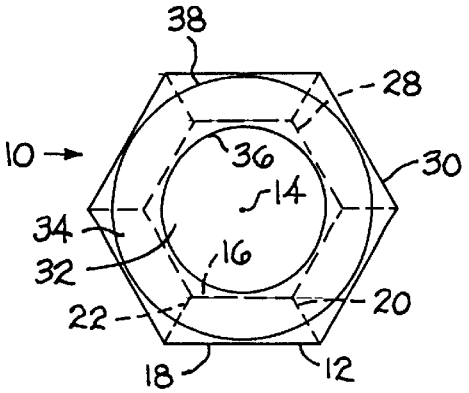
FIG. 4 is a bottom view of the six-sided die of FIG. 2.
Figure 7:
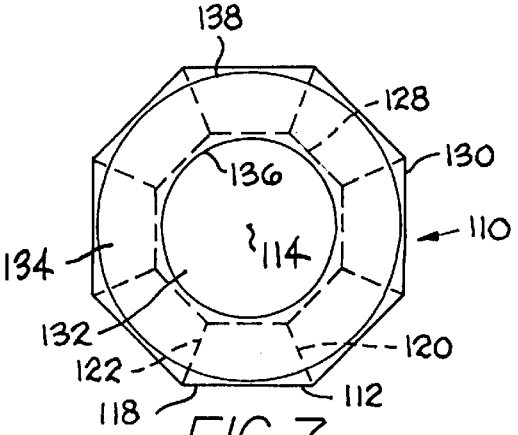
FIG. 7 is a bottom view of the six-sided die of FIG. 5.

FIGS. 2–4 and 8 show a preferred embodiment of the present invention. In this embodiment, the game die 10 is comprised of six identical, quadrilateral faces 12 which are arrayed about a central vertical axis 14. Each face 12 has an upper base edge 16, a lower base edge 18, and first and second side edges 20, 22. The length of the lower base edge 18 is greater than that of the upper base edge 16, such that when the faces 12 are joined along their respective side edges 20, 22, the faces 12 are inclined at a taper angle relative to the central vertical axis 14. The preferred taper angle is between eight and ten degrees. The die 10 has a first end 24 and a second end 26. The upper base edges 16 define a first polygon 28 at the first end 24 of the die 10, and the lower base edges 18 define a second polygon 30 at the second end of the die 10. As best shown in FIG. 4, the game die 10 is not solid but defines an internal cavity 32 which extends from the first end 24 of the die 10 to the second end 26. This internal cavity 32 may have a hexagonal cross-section that is defined by the faces 12 of the die 10. In this preferred embodiment, however, the internal cavity 32 is defined by a truncated conical surface, a continuous wall 34 having an upper rim 36 and a lower rim 38. The upper rim 36 is defined by a circle inscribed within the first polygon 28 formed by the upper base edges 16 of the faces 12, and the lower rim 38 is defined by a circle inscribed within the second polygon 30 formed by the lower base edges 18. The diameter of the first polygon 28 formed by the upper base edges 16 of the faces 12 is less than the diameter of the lower rim 38 of the internal cavity 32, the importance of which will be discussed further herein.

Figure 2A:
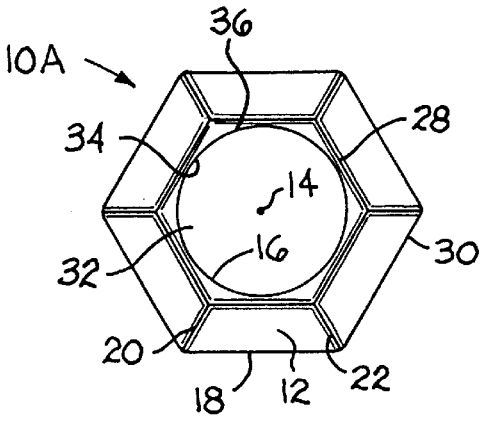
FIG. 2A is a top view of the six-sided die of FIG. 2, wherein the edges have been rounded.

FIG. 2A shows another embodiment of the die of the present invention, similar in all aspects to the die 10 described above except that the edges of this die 10A are rounded to facilitate rolling of the die 10A, as will be described further herein.

FIGS. 5–7 and 9 show a preferred embodiment of the game die of the present invention. In this embodiment, the die 110 is comprised of eight identical, quadrilateral faces 112 which are arrayed about a central vertical axis 114. Although only six and eight-sided dice are shown and discussed, a die made in accordance with the present invention may have anywhere from five to twelve faces. Again, each face 112 has an upper base edge 116, a lower base edge 118, and first and second side edges 120, 122. The length of the lower base edge 118 is greater than that of the upper base edge 116, such that when the faces 112 are joined along their respective side edges 120, 122, the faces 112 are inclined at a taper angle relative to the central vertical axis 114. Again, the preferred taper angle is between eight and ten degrees. The die 110 has a first end 124 and a second end 126. The upper base edges 116 define a first polygon 128 at the first end 124, and the lower base edges 118 define a second polygon 130 at the second end 126. The game die 110 is not solid but defines an internal cavity 132 which extends from the first end 124 of the die 110 to the second end 126. This internal cavity 132 is preferably defined by a truncated conical surface, a continuous wall 134 having an upper rim 136 and a lower rim 138. The upper rim 136 is defined by a circle inscribed within the first polygon 128, and the lower rim 138 is defined by a circle inscribed withing the second polygon 130.

Figure 5A:
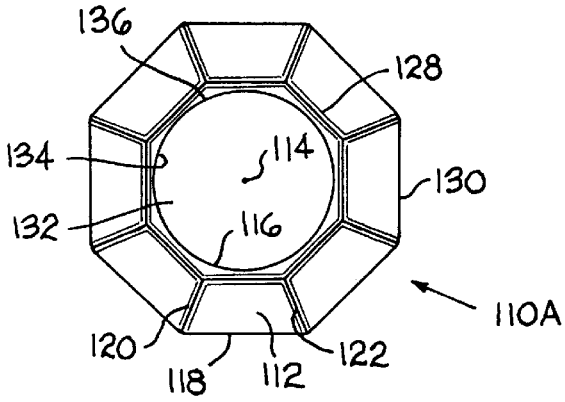
FIG. 5A is a top view of the eight-sided die of FIG. 5, wherein the edges have been rounded.

FIG. 5A shows another embodiment of the die of the present invention, similar in all aspects to the die 110 described above except that the edges of this die 110A are rounded to facilitate rolling of the die 110A.

Figure 1:
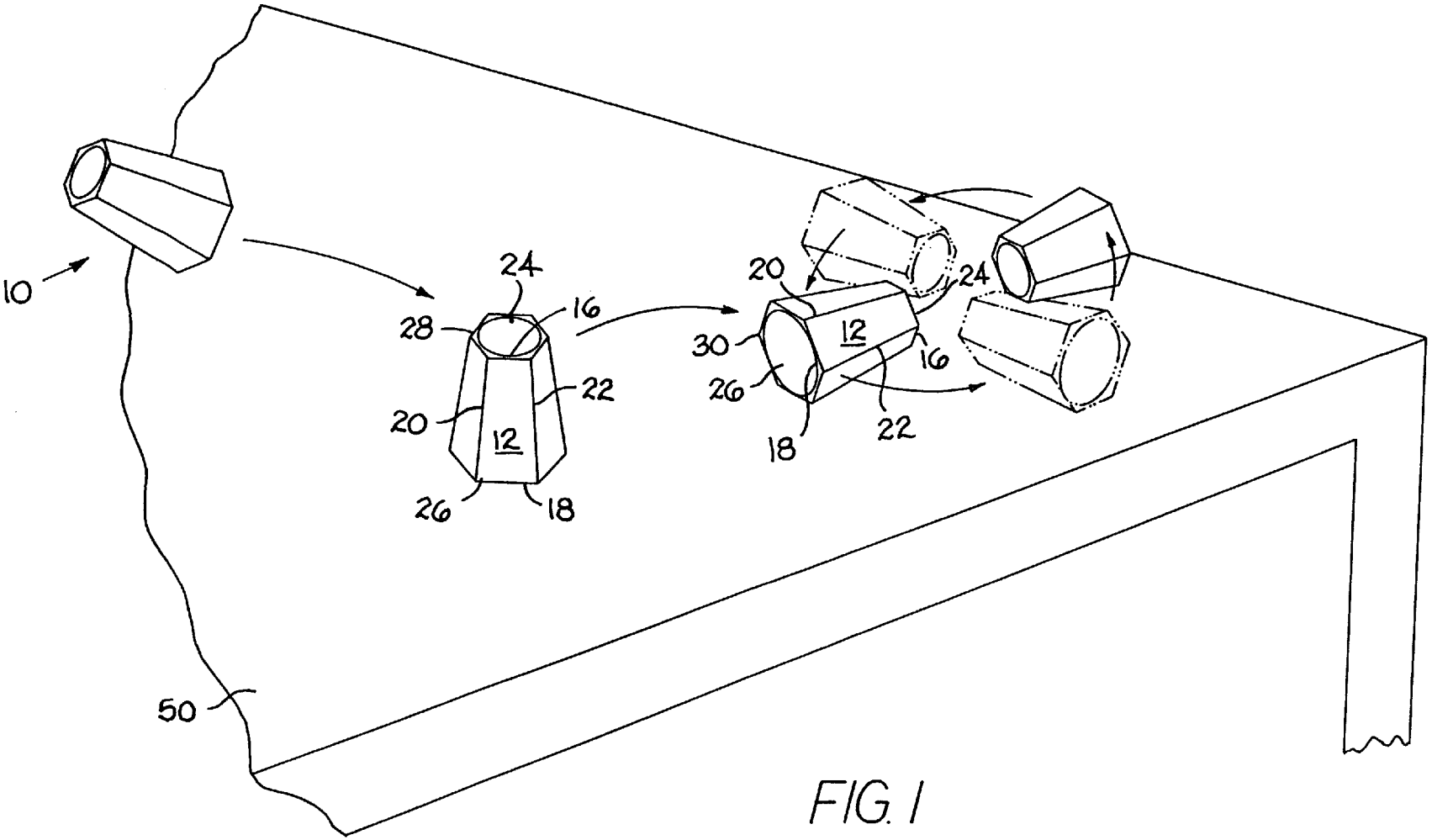
FIG. 1 is a perspective view of a die made in accordance with the present invention being thrown onto a table.
Figure 2:
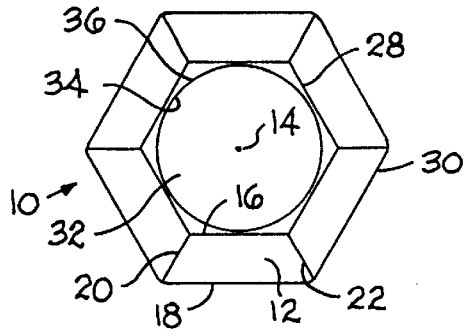
FIG. 2 is a top view of a six-sided die made in accordance with the present invention.
Figure 5:
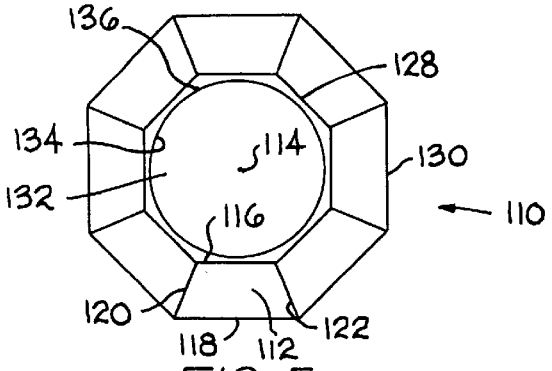
FIG. 5 is a top view of a eight-sided die made in accordance with the present invention.
Figure 3:
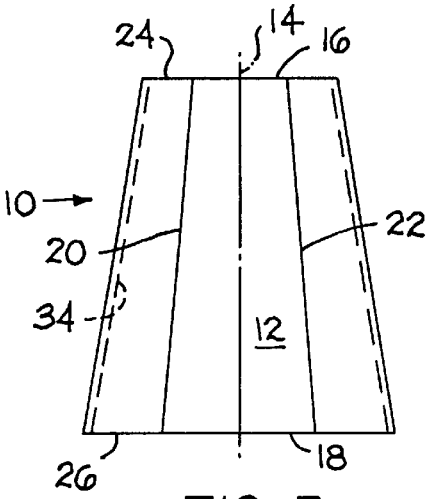
FIG. 3 is a side view of the six-sided die of FIG. 2.
Figure 6:
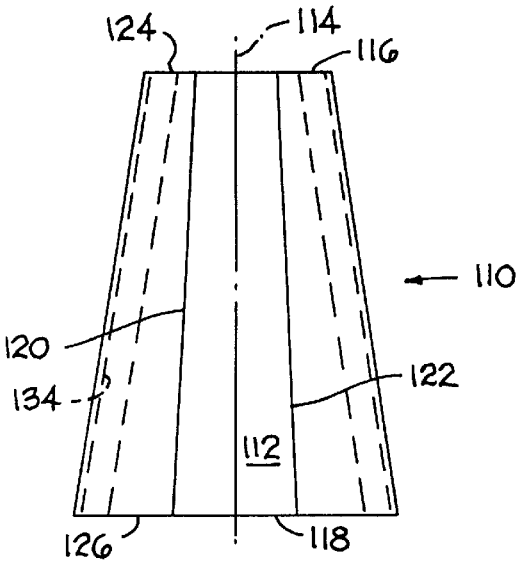
FIG. 6 is a side view of the six-sided die of FIG. 5.

Referring now to FIG. 1, a six-sided game die 10 is being thrown onto a table 50. As shown, the die 10 strikes the table 50 and falls onto one of its faces 12. To prevent the die 10 from coming to rest on one of its ends rather than a face 12, the length of each face 12, measured from the upper base edge 16 to the lower base edge 18, is greater than the vertex-to-vertex diameter of the first and second polygons 28, 30. It is preferred that the ratio between the length of each face 12 and the vertex-to vertex diameter of the second polygon 30 be greater than 1.25 to 1, thereby greatly reducing the likelihood that the die 10 will come to rest on the second end 26 or the smaller first end 24. The best dice have a ratio of approximately 1.50 to 1. Because the faces 12 of the die 10 are tapered, the die 10 rolls in a circle about a central point once sliding ceases, as indicated in FIG. 1, thereby preventing the die 10 from sliding off of the table 50 onto which it is thrown.

Figure 10:
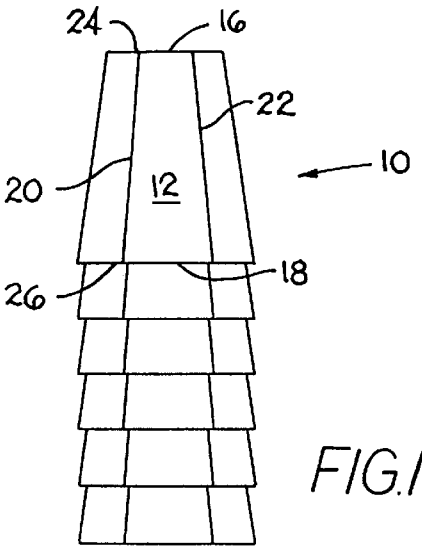
FIG. 10 is a side view of a series of six-sided dice stacked for storage.
Figure 8:
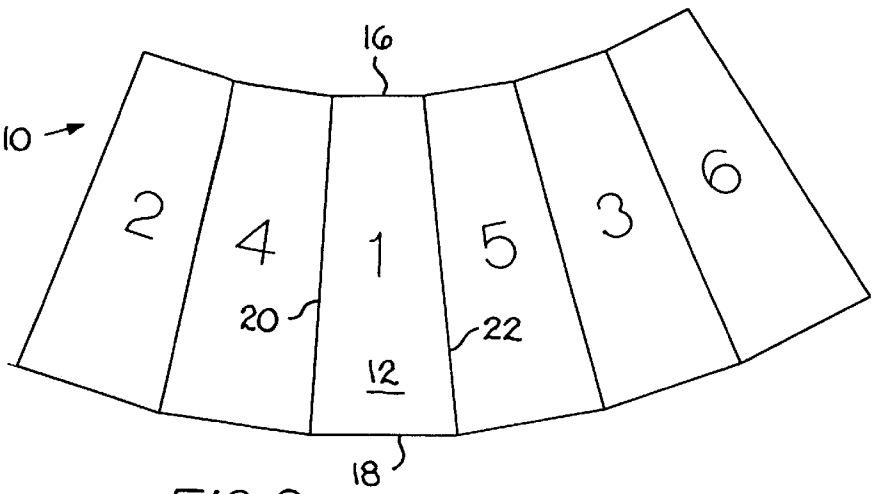
FIG. 8 is lay-out view of the six-sided die of FIG. 2, showing a preferred series of numerical indicia to be displayed on the faces of the die.
Figure 9:
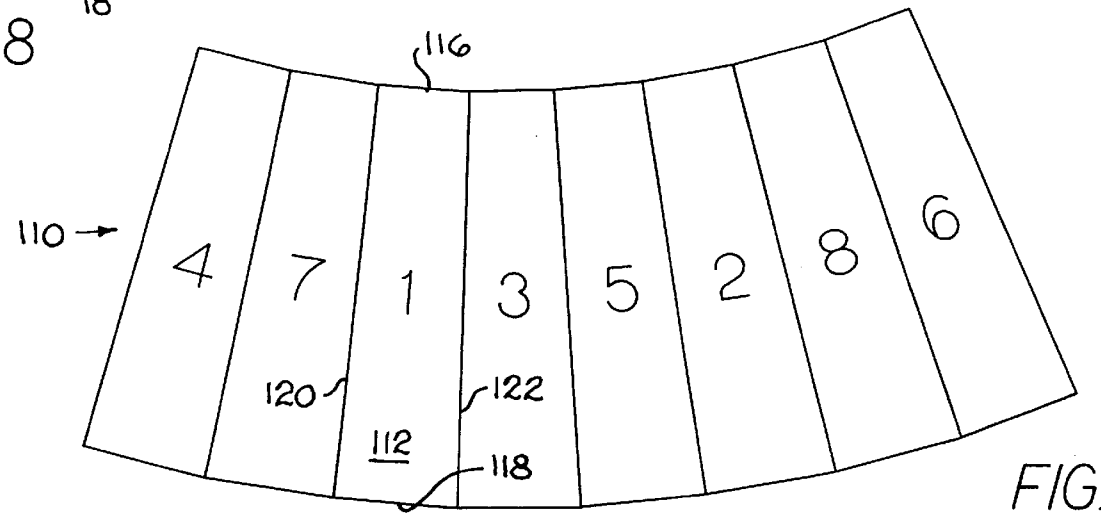
FIG. 9 is a lay-out view of the six-sided die of FIG. 5, showing a preferred series of numerical indicia to be displayed on the faces of the die.

Another principal feature of the die of the present invention is its stackability, that is, the ability to stack one die atop another. As mentioned in the above description, it is important that the diameter of the first polygon 28 formed at the first end 24 of the die 10 have a diameter that is smaller than that of the lower rim 38 of the internal cavity 32. Because of this, the first end 24 of one die may be fit into the internal cavity 32 defined by a second die. FIG. 10 shows how six dice may be stacked atop one another. Moreover, if the first end 24 of each die is open (as in the preferred embodiments described above), a stack of dice may be stored on a string, a pencil, or a similar slender body.

Figure 11:
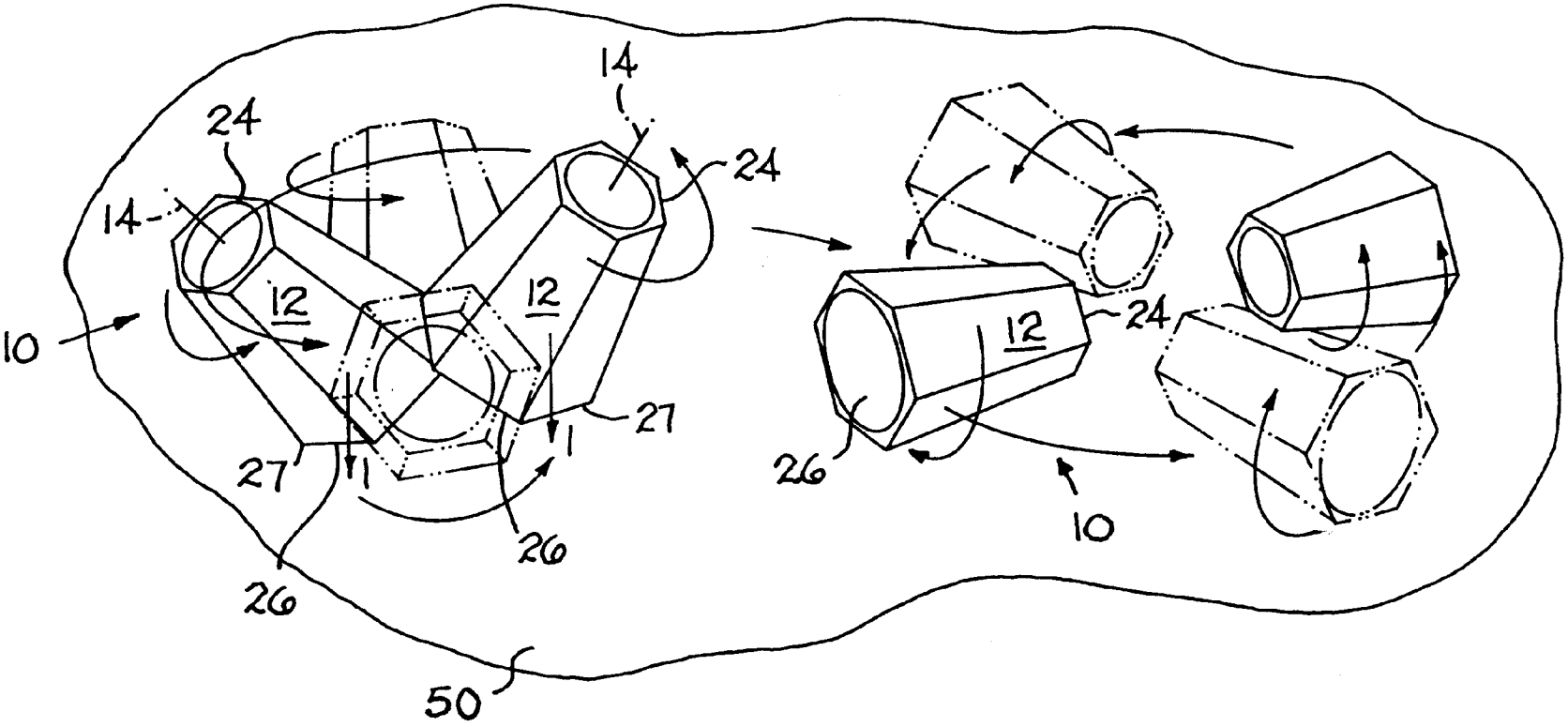
FIG. 11 is a perspective view of a die made in accordance with the present invention being spun on a table.

As discussed above, a preferred die 10 is constructed such that it will roll along its faces 12 about a central point when thrown onto a surface such as a table. Because of the shape and construction of the preferred die 10, it can also be spun like a top, as shown in FIG. 11. To spin the die 10, a user places the die 10 on a flat surface 50, with the second end 26 of the die 10 resting on that surface 50. The user grasps the die 10 along two or more of its faces 12 near the first end 24, and then spins the die 10 by imparting a rotational torque on the die 10 with his fingers. As shown in FIG. 11, this rotational torque causes the die 10 to rotate as its point of contact 27 with the surface 50 continually changes. The die 10 thus rotates about its central axis 14, but the position of this axis 14 relative to the table 50 is constantly shifting. This shifting of the central axis 14 of the die 10 eventually causes the die 10 to topple over onto one of its faces 12, where it begins to roll about a central point, as described above.

Toppling of the die 10 occurs when the rotational torque caused by the spinning of the die 10 is insufficient to overcome the torque produced by the gravitational force acting on the center of gravity of the die 10. As indicated by arrow 1 in FIG. 11, the gravitational force acts external to the faces 12 of the die 10 when the central axis 14 of the die 10 is sufficiently inclined from vertical. Assuming a constant wall thickness, the center of gravity of the die 10 is dependent on the relative diameters of the first and second ends 24, 26. The greater the ratio between the diameter of the second end 26 and that of the first end 24, the closer the center of gravity is to the second end 26 of the die 10. The preferred ratio between the diameter of the second end 26 and that of the first end 24 is between approximately 1.5 to 1 and 2.5 to 1. Thus, the center of gravity of a preferred die is between two-sevenths and two-fifths up the faces 12 of the die 10 along the central axis 14.

Dice made in accordance with the present invention can thus be used to play a variety of traditional games. For example, the game of YAHTZEE® requires five standard six-sided cubes for random number generation. These traditional dice are placed in a cup, shaken, and then rolled out of the cup onto a playing surface. These dice can be easily replaced with the dice of the present invention, solving the problem of dice rolling off of the playing surface. Moreover, the dice of the present invention provide for increased enjoyment of the game. Physical interaction with dice is an important aspect in making a game fun. The dice of the present invention allow players not only to throw the dice in the traditional manner, but allow for rolling of the dice or spinning of the dice as described above. The players are thus more physically involved with the game, and have the opportunity to manipulate the dice as they desire.

Use of the dice of the present invention is not limited to random number generation. By using indicia other than numerical indicia on the faces of each die, the dice may be used in a wide variety of games, solving the problem of dice rolling off of a surface and increasing the enjoyment of the game.

It is understood that changes may be made in the construction and arrangement of the various components of the present invention without departing from the spirit or scope of the invention as defined in the following appended claims.

What is claimed is:

1. A game die, adapted to be thrown or spun before coming to rest on a flat surface, comprising:

a first end;

a second end; and a plurality of planar quadrilateral faces, each of said faces adapted to display indicia and comprising:

an upper base edge defining an upper length;

a lower base edge defining a lower length, wherein said lower length is greater than said upper length; and first and second side edges;

wherein said faces are arrayed about a central vertical axis and are joined along adjacent first and second side edges;

wherein said faces are inclined at a taper angle relative to said vertical axis;

wherein the upper base edges of said faces form a first polygon at said first end, and the lower base edges of said faces form a second polygon at said second end; and wherein said faces define an internal cavity open at said first and second ends.

2. A game die as recited in claim 1, wherein said first end has a first diameter, and said second end has a second diameter, said second diameter being greater than said first diameter so that a portion of a second game die may be received within said internal cavity.

3. A game die as recited in claim 2, wherein said internal cavity is defined by a truncated conical surface that extends from said first end to said second end.

4. A game die as recited in claim 3, wherein said truncated conical surface is a continuous wall which has an upper rim defined by a first circle inscribed within said first polygon and a lower rim defined by a second circle inscribed within said second polygon.

5. A game die as recited in claim 1, wherein a plurality of lateral edges are formed at the juncture of said faces along their respective adjacent first and second side edges, and wherein said lateral edges are rounded to facilitate rolling of the die along said faces.

6. A game die as recited in claim 1 wherein said taper angle is between eight and ten degrees.

7. A game die as recited in claim 1 wherein the distance between said first end and said second open end is between 1 and 1½ inches.

* * * * *